US007478672B2

(12) United States Patent
Rogers et al.

(10) Patent No.: US 7,478,672 B2
(45) Date of Patent: Jan. 20, 2009

(54) APPARATUS FOR CONTROLLING A PRESSURE CONTROL ASSEMBLY IN A HAZARDOUS AREA

(75) Inventors: Brian Rogers, Houston, TX (US); Alan Burkhard, Houston, TX (US)

(73) Assignee: M-I L.L.C., Houston, TX (US)

( * ) Notice: Subject to any disclaimer, the term of this patent is extended or adjusted under 35 U.S.C. 154(b) by 189 days.

(21) Appl. No.: 11/367,132

(22) Filed: Mar. 1, 2006

(65) Prior Publication Data

US 2006/0201671 A1 Sep. 14, 2006

Related U.S. Application Data

(60) Provisional application No. 60/658,640, filed on Mar. 4, 2005.

(51) Int. Cl.
*E21B 47/00* (2006.01)

(52) U.S. Cl. ..... 166/53; 166/66.6; 166/250.15

(58) Field of Classification Search ..... 166/52, 166/53, 65.1, 66, 6, 66.7, 250.15
See application file for complete search history.

(56) References Cited

U.S. PATENT DOCUMENTS

| | | | | |
|---|---|---|---|---|
| 5,732,776 | A | 3/1998 | Tubel et al. | |
| 6,484,816 | B1 | 11/2002 | Koederitz | |
| 6,575,244 | B2 | 6/2003 | Chang et al. | |
| 6,755,261 | B2 | 6/2004 | Koederitz | |
| 2005/0092523 | A1 * | 5/2005 | McCaskill et al. | 175/38 |

OTHER PUBLICATIONS

International Search Report and Written Opinion, issued Sep. 25, 2007, for International Application No. PCT/US06/07837, filed Mar. 3, 2006.

* cited by examiner

*Primary Examiner*—William P Neuder

(57) ABSTRACT

An apparatus operable is a hazardous area for controlling a choke assembly includes an air source, an air purge system in fluid communication with the air source, a remote operating panel receiving data from at least one remotely located wellbore sensor, a local operating panel in electronic communication with the remote operating panel, and an actuator coupled to the assembly to control pressure within the wellbore. The remote operating panel includes an airtight housing in fluid communication with the air purge system, wherein air from the air purge system is circulated through the housing, a plurality of operator controls for manually controlling operation of the pressure control assembly, and a display for visually displaying values of data received from the wellbore sensor. The local operating panel includes an airtight panel housing in fluid communication with the air purge system, wherein air from the air purge system is circulated through the panel housing, and a local operator controller having an operator interface for receiving operator instruction input into the local panel, and operable to receive operator instructions from the remote panel and transmit operator instructions. The actuator includes a motor in an explosion-proof housing coupled to the choke plate and operable to adjust the orifice through the choke plate, wherein the motor receives electronic communication of the operator instructions transmitted by the local operator controller, and a position indicator coupled to the choke plate for sensing the orifice opening and providing feedback of the choke plate position to the motor.

16 Claims, 10 Drawing Sheets

APPARATUS FOR CONTROLLING A PRESSURE CONTROL ASSEMBLY IN A HAZARDOUS AREA

This application claims priority to U.S. Provisional Patent Application Ser. No. 60/658,640 filed on Mar. 4, 2005 entitled, "Electric Control System for a Pressure Control Device in a Hazardous Area" incorporated herein by reference for all purposes.

BACKGROUND OF INVENTION

High pressure valves, or chokes, are often positioned at the wellhead to control flow. There are three main types of chokes: manual chokes, which require the user to be physically in the manifold and operate the choke by hand as the gas flows through; hydraulic chokes, which allow the user to operate the choke remotely from the drilling floor or doghouse; and electric chokes, which also allow the user to operate the choke remotely and are able to perform consistently in varying environmental conditions as well as add digital capabilities to the choke.

At locations where oil or gas wells are being drilled, a number of flammable gases may be present, including mixtures of oxygen, methane, ethane, propane, hydrogen sulfide and others. Similar potentially dangerous environmental conditions exist in locations in which petroleum products are being recovered, refined or processed. Standardized classifications for various types of hazardous locations have been adopted and assigned by regulatory agencies according to the nature and type of hazard that is generally present or that may occasionally be present.

Because electrical components, by their nature, may generate heat and sparks sufficient to ignite a flammable gas or other flammable mixture under even normal operating conditions, such components must be carefully selected and installed when used in an area that is classified as hazardous. More specifically, the components must exceed certain minimum standards as to such characteristics as power consumption, operating temperature, current and voltage requirements, and energy storage capabilities. These standards are also established by regulatory authorities and vary depending upon the particular hazardous environment.

Chokes positioned at the wellhead are often located in areas that are classified as hazardous. As such, the use of electric chokes may be limited to uses where they are not at the wellhead or in a hazardous area. It would be an improvement to have an electric choke that could be used at the wellhead or in other hazardous areas.

SUMMARY

In one aspect, the present invention relates to an apparatus for controlling a choke assembly, wherein the choke assembly includes a housing having an inlet and an outlet in fluid communication with a wellbore, a fixed plate located between the inlet and the outlet and having an orifice therethrough for communicating fluid from the inlet to the outlet, a choke plate rotatably retained against the fixed plate and having an orifice therethrough, wherein the choke plate is rotatable to adjust a size of an orifice resulting from the relative positions of the orifice through the choke plate and the orifice through the fixed plate and is further rotatable to close the resulting orifice to prevent fluid communication therethrough. The apparatus may include an air source, an air purge system in fluid communication with the air source, a remote operating panel receiving data from at least one remotely located wellbore sensor, a local operating panel in electronic communication with the remote operating panel, and an actuator coupled to the assembly to control pressure within the wellbore. The remote operating panel may include an airtight housing in fluid communication with the air purge system, wherein air from the air purge system is circulated through the housing, a plurality of operator controls for manually controlling operation of the pressure control assembly, and a display for visually displaying values of data received from the wellbore sensor. The local operating panel may include an airtight panel housing in fluid communication with the air purge system, wherein air from the air purge system is circulated through the panel housing, and a local operator controller having an operator interface for receiving operator instruction input into the local panel, and operable to receive operator instructions from the remote panel and transmit operator instructions. The actuator may include a motor in an explosion-proof housing coupled to the choke plate and operable to adjust the orifice through the choke plate, wherein the motor receives electronic communication of the operator instructions transmitted by the local operator controller, and a position indicator coupled to the choke plate for sensing the orifice opening and providing feedback of the choke plate position to the motor.

In another aspect, the present invention relates to an apparatus for a plurality of choke assemblies, wherein each choke assembly includes a housing having an inlet and an outlet in fluid communication with a wellbore, a fixed plate located between the inlet and the outlet and having an orifice therethrough for communicating fluid from the inlet to the outlet, a choke plate rotatably retained against the fixed plate and having an orifice therethrough, wherein the choke plate is rotatable to adjust a size of an orifice resulting from the relative positions of the orifice through the choke plate and the orifice through the fixed plate and is further rotatable to close the resulting orifice to prevent fluid communication therethrough. The apparatus may include an air source, an air purge system in fluid communication with the air source, a remote operating panel receiving data from at least one remotely located wellbore sensor, a local operating panel corresponding to each choke assembly being controlled, wherein each local operating panel is in electronic communication with the remote operating panel, and an actuator corresponding to each choke assembly and coupled thereto. The remote operating panel may include an airtight housing in fluid communication with the air purge system, wherein air from the air purge system is circulated through the housing, a toggle switch for selecting one of the choke assemblies to be controlled, a plurality of operator controls for manually controlling operation of the selected choke assembly, and a display for visually displaying values of data received from the wellbore sensor. Each local operating panel may include an airtight panel housing in fluid communication with the air purge system, wherein air from the air purge system is circulated through the panel housing, and a local operator controller having an operator interface for receiving operator instruction input into the local panel, and operable to receive operator instructions from the remote panel and transmit operator instructions. The actuator may include a motor in an explosion-proof housing coupled to the choke plate and operable to adjust the orifice through the choke plate, wherein the motor receives electronic communication of the operator instructions transmitted by the local operator controller, and a position indicator coupled to the choke plate for sensing the orifice opening and providing feedback of the choke plate position to the motor.

In yet another aspect, the present invention relates to an apparatus for controlling pressure in a wellbore including a choke assembly, wherein the choke assembly includes a housing having an inlet and an outlet in fluid communication with the wellbore, a fixed plate between the inlet and the outlet having an orifice therethrough for communicating fluid from the inlet to the outlet, a choke plate rotatably retained against the fixed plate and having an orifice therethrough, wherein the choke plate is rotatable to adjust a size of an orifice resulting from the relative positions of the orifice through the choke plate and the orifice through the fixed plate and is rotatable to close the resulting orifice to prevent fluid communication therethrough. The apparatus may also include an air source, an air purge system in fluid communication with the air source, a remote operating panel receiving data from at least one remotely located wellbore sensor, a local operating panel in electronic communication with the remote operating panel, and an actuator coupled to the assembly to control pressure within the wellbore. The remote operating panel may include an airtight housing in fluid communication with the air purge system, wherein air from the air purge system is circulated through the housing, a plurality of operator controls for manually controlling operation of the pressure control assembly, and a display for visually displaying values of data received from the wellbore sensor. The local operating panel may include an airtight panel housing in fluid communication with the air purge system, wherein air from the air purge system is circulated through the panel housing, and a local operator controller having an operator interface for receiving operator instruction input into the local panel, and operable to receive operator instructions from the remote panel and transmit operator instructions. The actuator may include a motor in an explosion-proof housing coupled to the choke plate and operable to adjust the orifice through the choke plate, wherein the motor receives electronic communication of the operator instructions transmitted by the local operator controller, and a position indicator coupled to the choke plate for sensing the orifice opening and providing feedback of the choke plate position to the motor.

Other aspects and advantages of the claimed subject matter will be apparent from the following description and the appended claims.

DETAILED DESCRIPTION

In one aspect, embodiments disclosed herein are directed to an apparatus for controlling a pressure control device. In another aspect, embodiments disclosed herein are directed to an apparatus for controlling a plurality of pressure control devices. In yet another aspect, embodiments disclosed herein are directed to an apparatus for controlling pressure of a fluid in a weilbore. In each embodiment disclosed, the apparatus meets the requirements of Class 1, Division 1 standards as established by the American Petroleum Institute (API) and published in the API "Recommended Practice for Classification of Locations for Electrical Installations at Petroleum Facilities," API Recommended Practice 500 (RP500), First Edition, Jun. 1, 1991, specifically incorporated herein by this reference.

Figure 1:
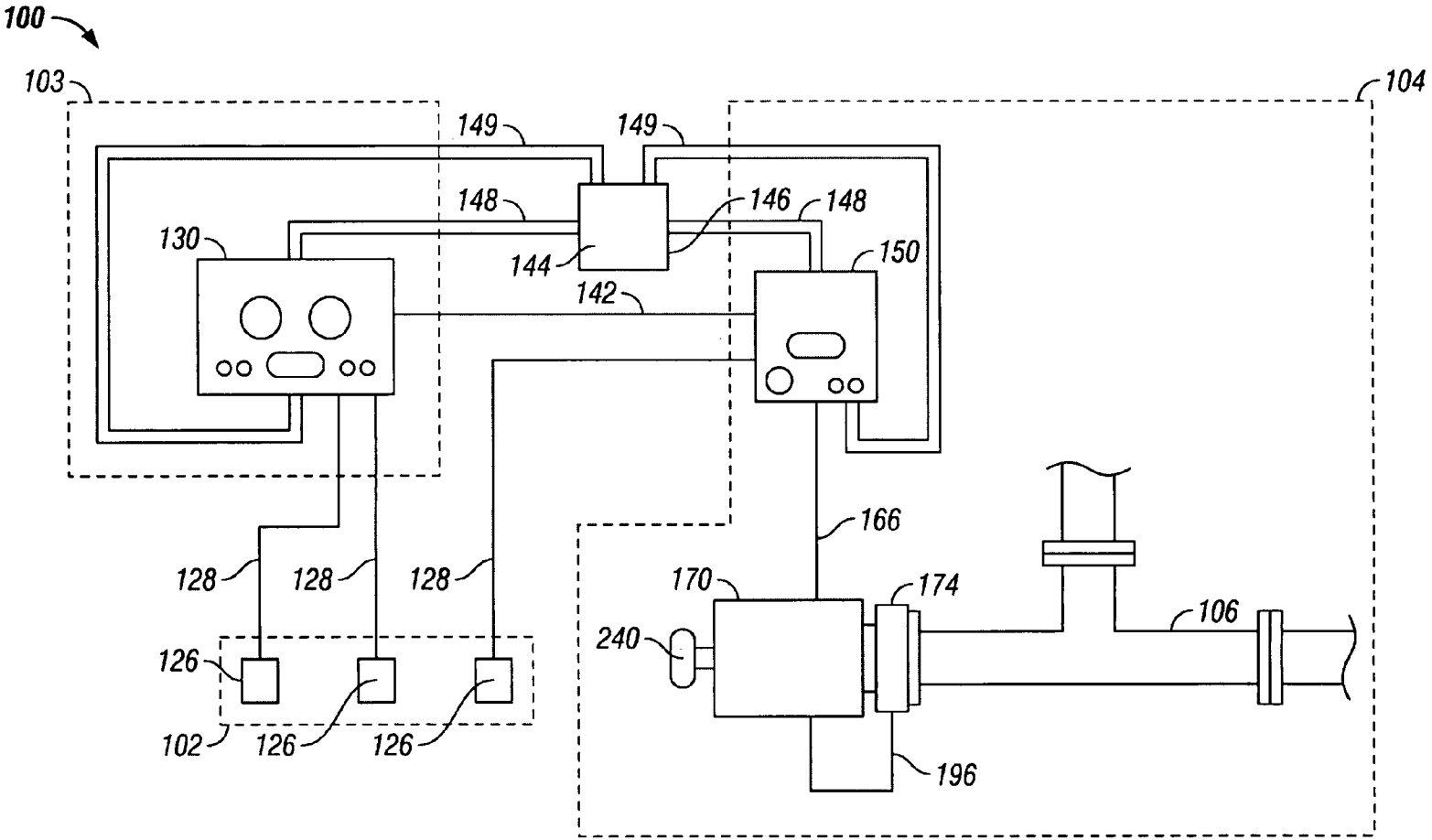
FIG. 1 is a schematic of a control system for automatic pressure control.

Referring to FIG. 1, an apparatus for controlling a pressure control device is shown generally as 100. The terms "pressure control device," "pressure control assembly," and "choke assembly" are used herein, interchangeably, to refer to an apparatus that is used to regulate the pressure in a wellbore.

Figure 8:
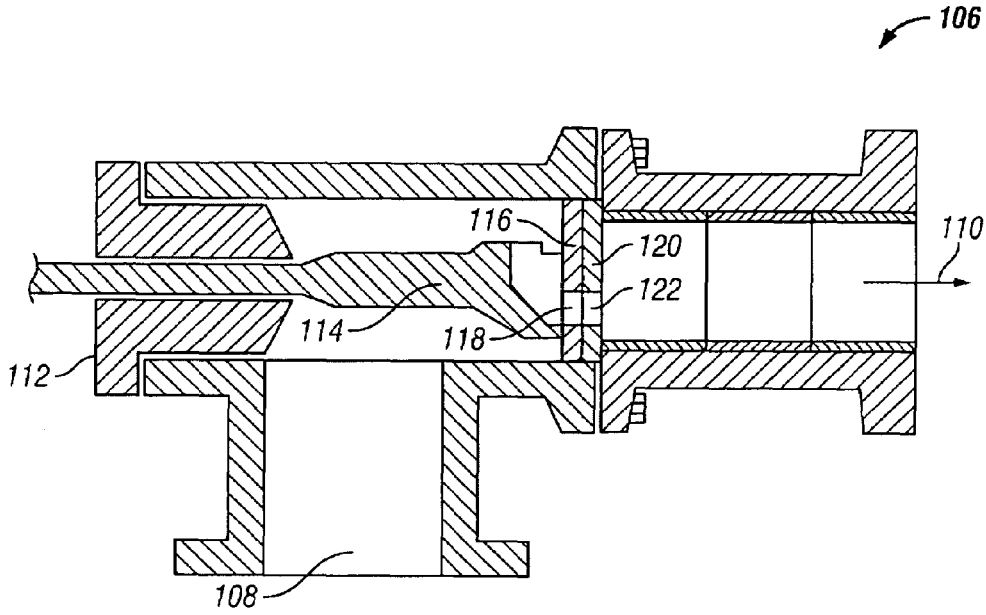
FIG. 8 (Prior Art)
FIG. 8 is a cross sectional side view of a choke assembly.
Figure 9A:
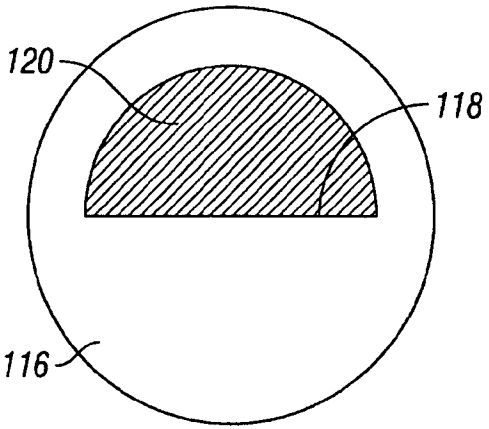
FIG. 9A (Prior Art)
FIGS. 9A-C depict choke plate positioning with respect to a fixed opening.
Figure 9B:
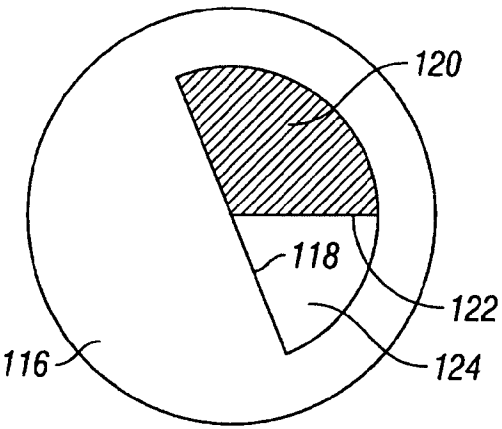
FIG. 9B (Prior Art)
Figure 9C:
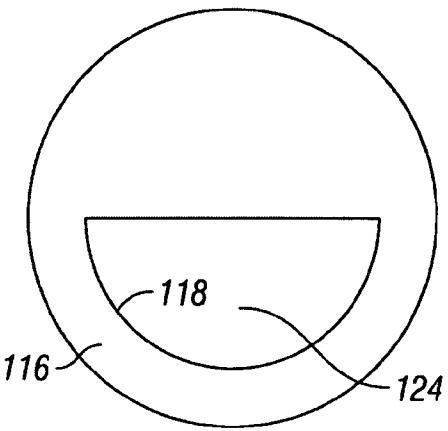
FIG. 9C (Prior Art)

Referring to FIG. 8, the choke assembly 106 with which the apparatus 100 is to be used has a fluid inlet 108 and a fluid outlet 110, which are typically oriented such that they are right angles. An actuator end 112 is located opposite the fluid outlet 110. The fluid path between the fluid inlet 108 and the fluid outlet 110 is controlled by a rotatable choke plate 116 and a fixed plate 120. As shown in FIGS. 9A-C, in one embodiment, the rotatable choke plate 116 has a half-moon shaped aperture 118 through its surface and the fixed plate 120, downstream from the choke plate 116 has a fixed aperture 122 through it. A fluid aperture 124 is defined when the choke plate aperture 118 and the fixed aperture 122 overlap to provide fluid communication through both apertures 118 and 122, as may be seen in FIGS. 9B and 9C. As the choke plate 116 is rotated relative to the fixed aperture 122 the size of the fluid aperture 124 varies. In this embodiment, the choke plate 116 is rotatable between a full closed position, shown in FIG. 9A, and a full open position, shown in FIG. 9C. In one embodiment, an actuator fork 114 coupled to the choke plate 116 is rotated to rotate the choke plate 116. Pressure within the wellbore is controlled and adjusted by varying the fluid aperture 124 through the choke assembly 106.

Referring, again, to FIG. 1, in one embodiment, the apparatus 100 includes a remote panel 130, a local panel 150, an actuator 170, and at least one sensor 126. In one embodiment, the remote panel 130 is located in a doghouse or on a drilling floor of a rig 103. In one embodiment, the local panel 150 is located at a choke manifold 104. In one embodiment, the local panel is located within 30 feet of the actuator 170. The actuator 170 is coupled to the actuating end 112 of a choke assembly 106. One or more sensors 126 are located within the wellbore 102 to measure predetermined parameters.

Figure 3:
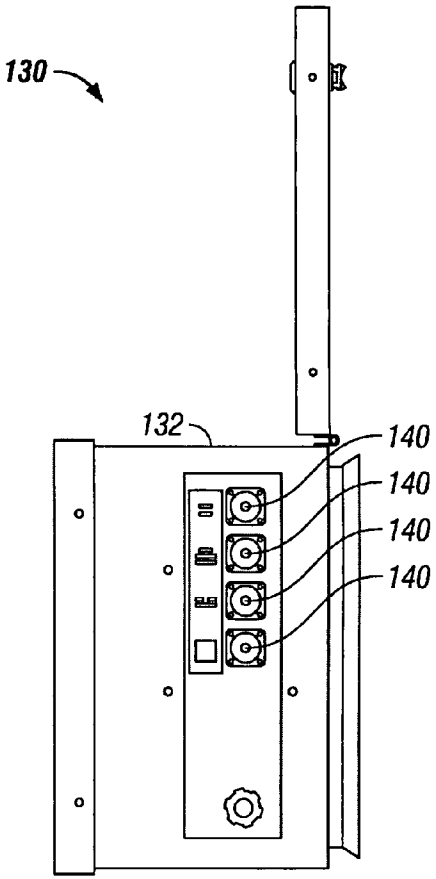
FIG. 3 is a side view of a remote actuator panel.
Figure 2:
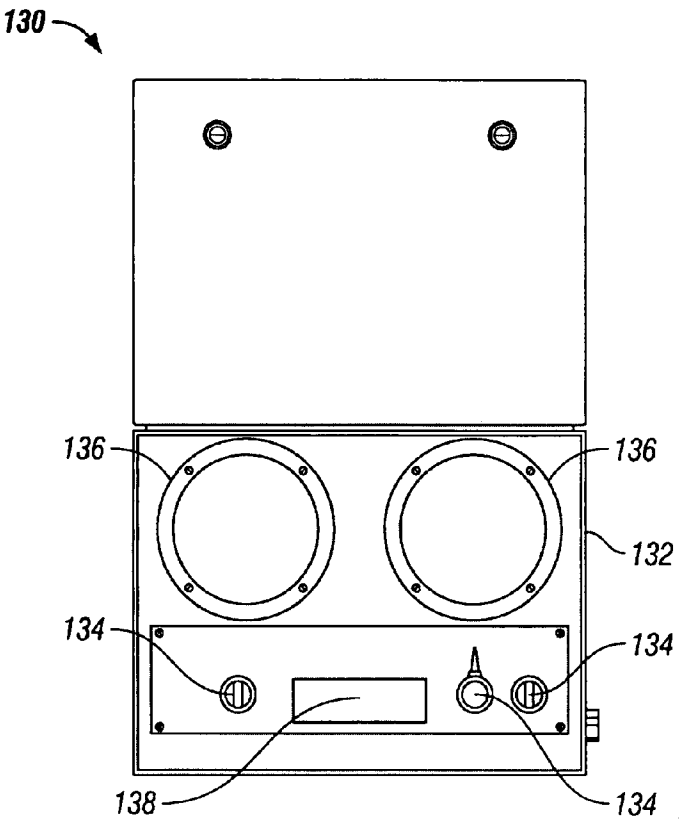
FIG. 2 is a front view of a remote actuator panel.

The remote panel 130 of the control system 100 is shown in FIGS. 2 and 3. In one embodiment, the remote panel 130 includes a housing 132 within which controls 134 are included. In one embodiment, controls 134 include a speed dial, an open/close lever, a contrast, and/or a stroke reset switch. In one embodiment, analog gauges 136 are included to provide information to the operator regarding relevant conditions in the wellbore 102. A digital display 138 provides data from one or more choke assemblies 106 to the operator. In one embodiment, the digital display 138 also provides visual menus to the operator. In one embodiment, menus guide an operator through calibration of the actuator controls and choke 106 adjustments. Referring to FIG. 3, a plurality of electronic inputs 140 are included through housing 132 to provide input of electronic data from one or more sensor communication cables 128 connecting one or more sensors 126 to the remote panel 130. A panel communication cable 142 also connects the local panel 150 to the remote panel 130 electronically.

Referring again to FIG. 1, an air purge system 144 ensures that the remote panel 130 is safe for operation in an area that is classified as hazardous. An air source 146 provides air to the air purge system 144. In one embodiment, the air source 146 for the air purge system 144 is from the rig. In another embodiment, the air source 146 is a separate air source dedicated to the apparatus 100. The air purge system 144 is in fluid communication with the housing 132 of the remote panel 130, which is airtight. The purge system 144 includes feed lines 148 and intake lines 149 to communicate air into and out of the housing 132. The clean air provided to the remote panel 130 prevents any hazardous gases from entering the housing 132.

The local panel 150 provides a secondary interface for an operator to control the choke assembly 106. The local panel 150 has a local panel housing 158.

Figure 4:
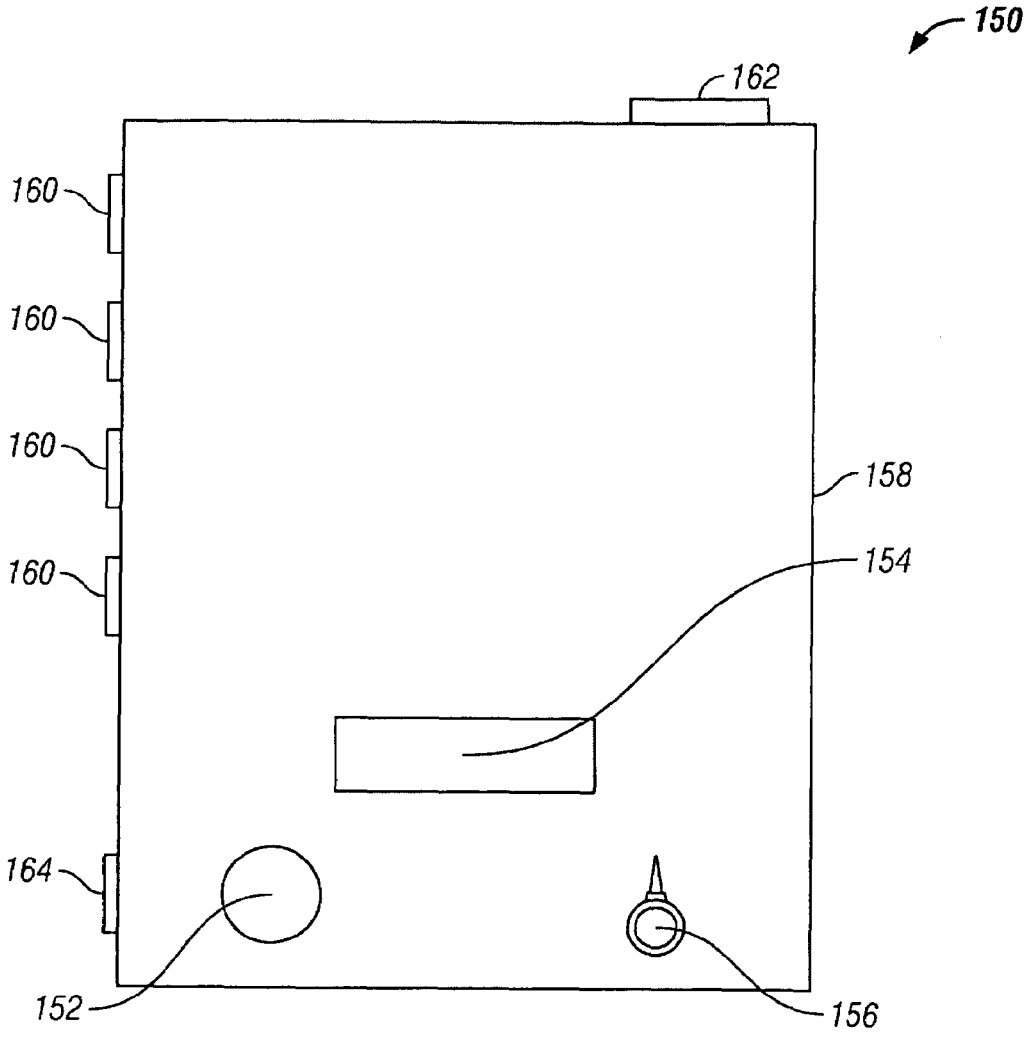
FIG. 4 is a front view of a local panel.

Referring to FIG. 4, in one embodiment, the local panel 150 includes one or more basic controls 156. In this embodiment, the controls 156 allow the operator to operate the choke 106 from the local panel 150. In one embodiment, basic controls 156 include an open/close lever. In this embodiment, the open/close lever allows the operator to electronically actuate the choke 106 from the manifold 104. In one embodiment, no speed control is provided on the local panel 150 and the lever operates differently from the open/close lever on the remote panel 130. In this embodiment, as the lever on the local panel 150 is moved to either an open or closed mark, the actuator 170 begins to rotate at a percentage of its maximum speed. The actuator rotation speed accelerates to full speed within a predetermined time allowing the operator to make fine tuned movements in short bursts and to also fully open/close the valve quickly. In another embodiment, a speed controller is provided on the local panel 150.

In one embodiment, an electronic input 160 is included through the side of housing 158 to provide electronic data along a sensor communication cable 128 to the local panel 150 from a sensor 126 in the wellbore 102. In one embodiment, a plurality of electronic inputs 160 are included through the side of housing 158 to provide electronic data to the local panel 150 from a plurality of sensors 126 in the wellbore 102. In one embodiment, an electronic interface 160 is also included for the panel communication cable 142 between the local panel 150 and the remote panel 130.

The air purge system 144 ensures that the local panel 150 is safe for operation in an area that is classified as hazardous. The purge system includes feed lines 148 and intake lines 149 to communicate air into and out of the local panel 150 through an air feed opening 162 and air discharge 164, respectively, in local housing 158. Local housing 158 is airtight to prevent the entry of hazardous gases.

In one embodiment, the local panel 150 includes an emergency stop button 152. In this embodiment, actuation of the emergency stop button shuts off power to the actuator 170, thereby providing a class A shutdown of the choke 106.

In one embodiment, the local panel 150 includes a digital display 154. In this embodiment, an operator can observe measurements taken by one or more sensors 126.

Figure 5:
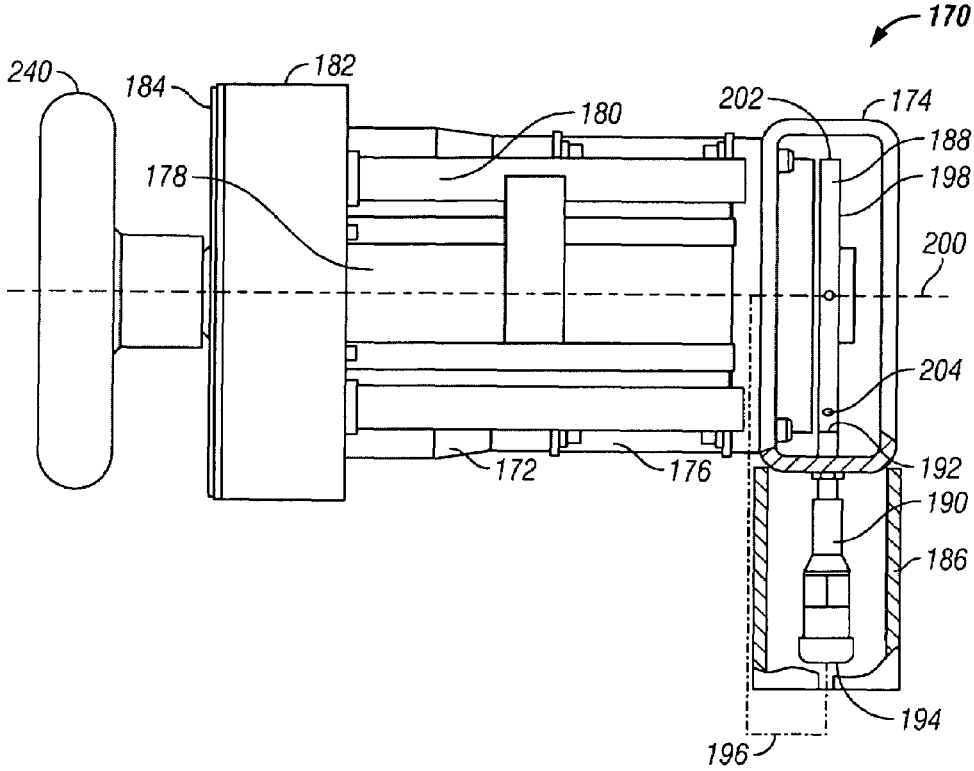
FIG. 5 is a top view of the actuator with a cutaway view of a proximity switch guard.
Figure 6:
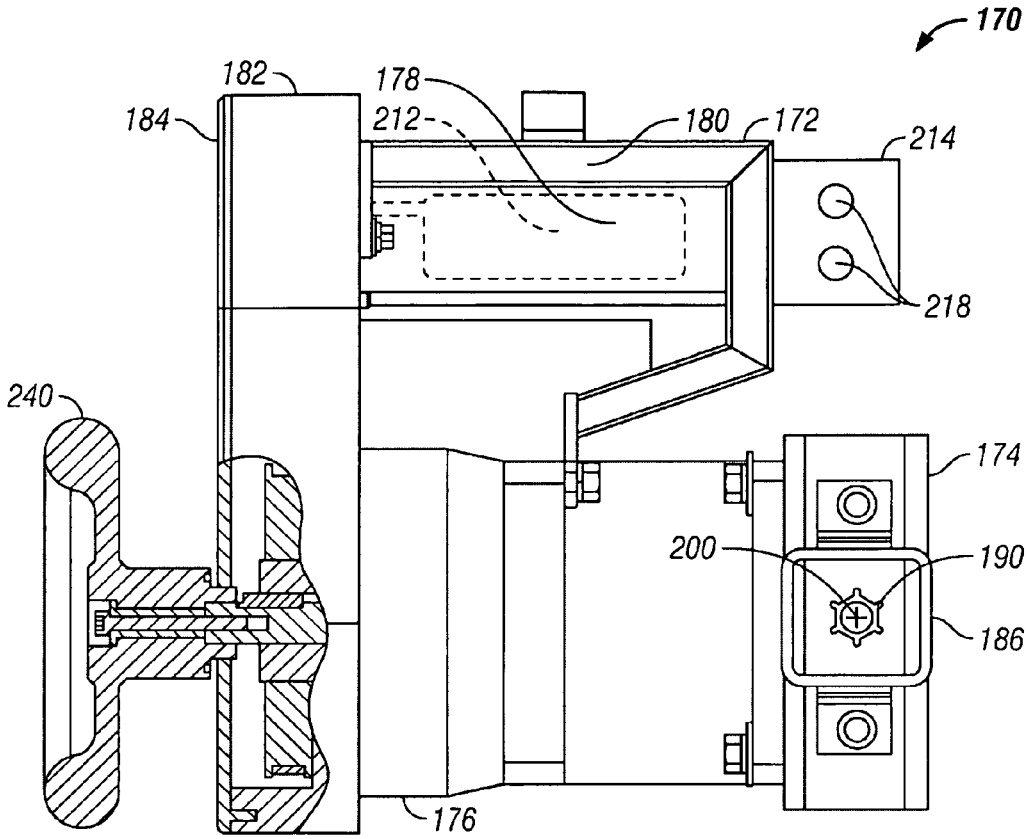
FIG. 6 is a side view of the actuator with a cutaway view of the hand wheel section.
Figure 7:
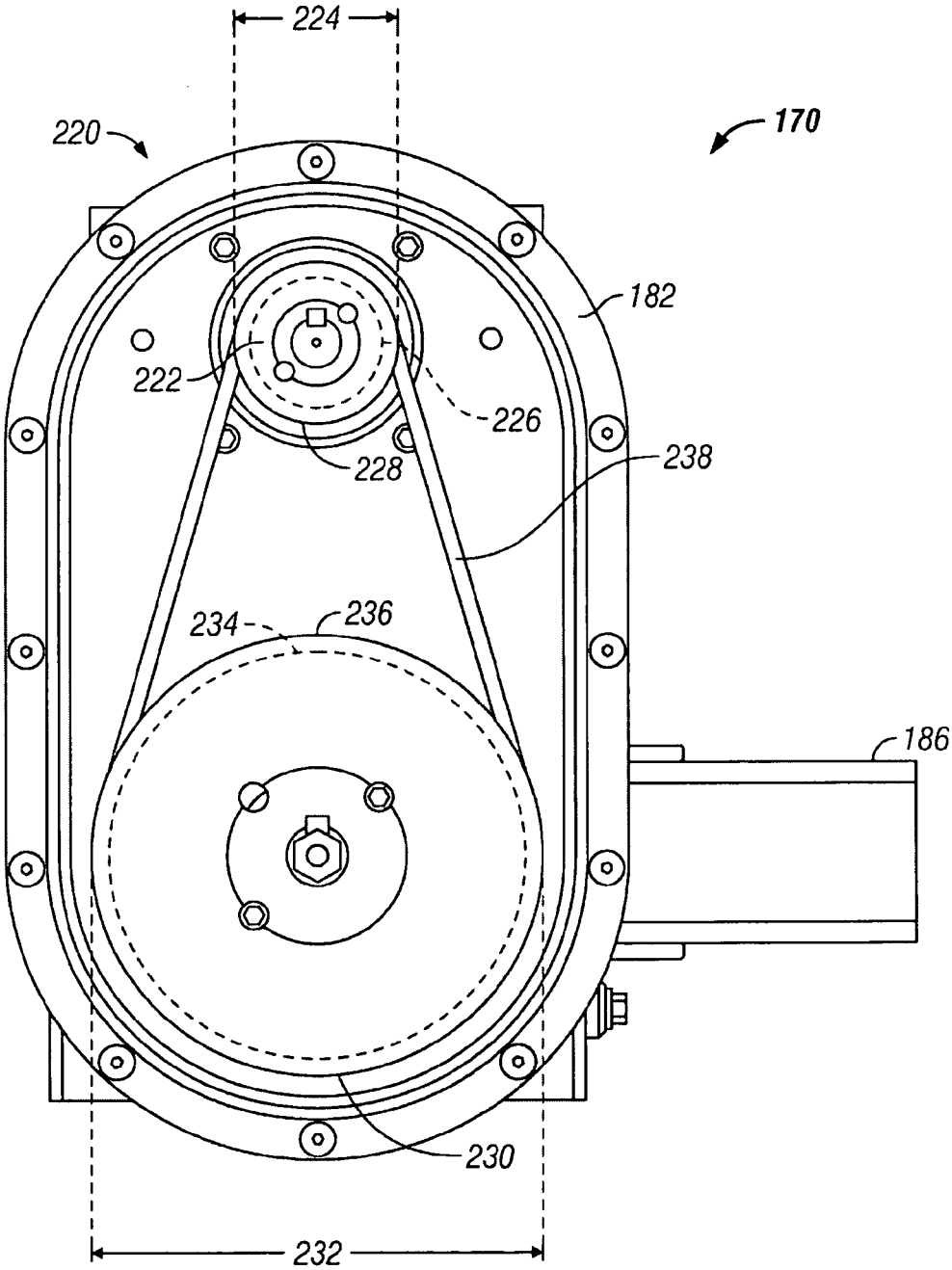
FIG. 7 is an end view of the actuator with the hand wheel removed to show the belt drive.

The actuator 170 is shown in FIGS. 5-7. The actuator 170 is coupled to the choke assembly 106 and provides an interface between the remote panel 130 and/or the local panel 150 and the choke assembly 106. In one embodiment, the actuator 170 includes an actuator housing 172, a hand wheel 240, a motor 212, a position indicator 188, and a belt drive 220. In one embodiment, the actuator housing 172 includes an adapter 174, an actuator guard 176, a motor housing 178, a motor guard 180, and a belt guard 182 and belt guard lid 184.

The motor 212 is housed within the motor housing 178, which is coupled to the belt guard 182. To ensure that the motor 212 is safe for use in a hazardous area, the motor housing 178 is explosion proof. Further, a junction box 214 is provided to receive the control communication cable 166 from the local panel 150 and the switch communication cable 196. The junction box 214 is also explosion proof, with the control and switch communication cable inputs 218 being armored. The control communication cable 166 and switch communication cable 196 are also armored to ensure they are safe for use in a hazardous area. The junction box 214 is attached to the motor housing 178 and such that the power and sensor feedback are connected to the motor 212 within an enclosure formed by the junction box 214 and the motor housing 178. The motor 212 is connected to the belt drive 220.

Referring to FIG. 7, the belt guard 182 and the belt guard lid 184 form an enclosure within which the belt drive 220 is retained. In one embodiment, the belt drive 220 includes a first sprocket 222, a second sprocket 230, and a belt 238. In this embodiment, the first sprocket 222 has a first diameter 224 and includes a first groove 226 around its side 228. The second sprocket 230 has a second diameter 232 and includes a second groove 234 around its side 236. The first sprocket 222 is spaced apart from the second sprocket 230 within the belt guard 182 such that the belt 238 is taut about opposing portions of the first and second sprockets 222 and 224 and rests within the respective grooves 226 and 234. Output from the motor 212 interfaces with the first sprocket 222 of the belt drive 220 through corresponding holes in the motor housing 178 and the belt guard 182. Rotation by the first sprocket 222 is transferred to the second sprocket 230 by the belt 238. The first diameter 224 is less than the second diameter 232 resulting in more than one rotation of the first sprocket 222 being required to rotate the second sprocket 230 one full rotation. Factors used to determine the desired ratio between the first diameter 224 rotation and the second diameter 232 include the top motor speed, the speed at which it is desired that the choke plate 116 go from a full open position to a full closed position, the precision with which it is desired that the choke plate aperture 118 be positioned relative to the fixed aperture 122, and the variability of the control of the speed of the motor 212.

In one embodiment, an actuator fork 114 interfaces with the second sprocket 230. In this embodiment, the actuator fork 114 extends through a second hole in the belt guard 182 and is coupled to the choke plate 116.

In one embodiment, the hand wheel 240 provides manual control of the actuator fork 114 to rotate the choke plate 116 in the event of power loss or system failure. The hand wheel 240 is connected to a gear reducer (not shown) to increase the number of revolutions required to open and close the choke assembly 106. After the local panel 150 has been disabled, the manual hand wheel 240 can be used to fully open and close the choke plate 116 in a predetermined number of revolutions. The position of the choke plate 116 can be determined by observing the position indicator 188.

Figure 10:
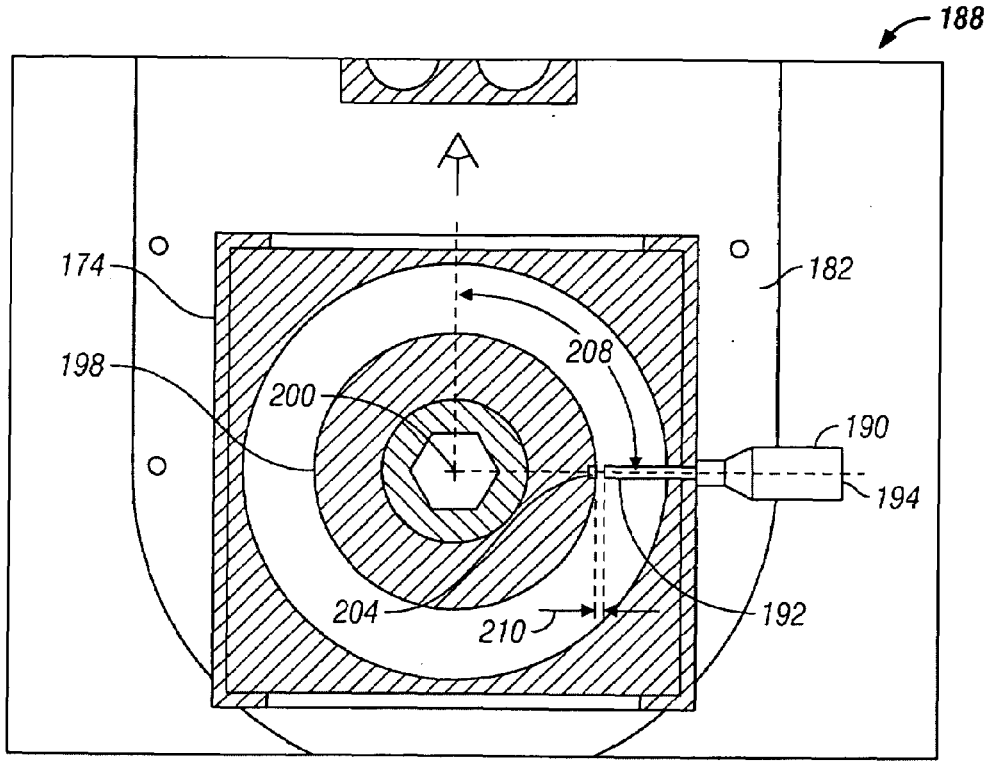
FIG. 10 is a cross sectional view of the position indicator.

The position indicator 188 is housed by the adapter 174, which is coupled to the actuator end 112 of the choke assembly 106. In one embodiment, shown in FIG. 10, the position indicator 188 includes a proximity switch 190 and an indicator ring 198. In this embodiment, the indicator ring 198 is cylindrical about a center axis 200 and has an indicator side 202. The indicator ring 198 is rotationally retained within the adapter 174 through its center axis 200. The indicator ring 198 is coupled to the choke plate 116. Thus, rotation of the indicator ring 198 corresponds to rotation of the choke plate 116.

In one embodiment, a magnet 204 is housed by the indicator ring 198, flush within the indicator side 202. In this embodiment, when the magnet 204 engages the proximity switch 190, a homing response is recognized by the motor 212. As the operator commands an open/close request to the motor 212 the motor 212 uses preprogrammed algorithms to interpret a homing response and turn the motor 212 a predetermined number of revolutions as required to open/close the choke plate 116.

In one embodiment, the proximity switch 190 is coupled to the adapter 174 such that a sensor end 192 is less than a predetermined distance 210 from the indicator side 202, but far enough from the indicator side 202 that the indicator ring 198 does not contact the sensor end 192 when rotating. The distance 210 between the indicator side 202 and the sensor end 192 is within the range in which the proximity switch 190 can sense the presence of the magnet 204. Thus, as the indicator ring 198 is rotated, the proximity switch 190 detects the magnet 204, which corresponds to a predetermined position of the choke plate 116.

In one embodiment shown in FIGS. 5-7, the proximity switch 190 is surrounded by a proximity switch guard 186 affixed to the adapter 174. The proximity switch guard 186 protects the proximity switch 190 from becoming dislodged or moved from position.

The proximity switch 190 has a connector end 194 to which a switch communication cable 196 is attached. In one embodiment, the switch communication cable 196 connects to the motor 212 through an open end of the proximity switch guard 186 to provide feed back to the motor 212 of whether the magnet 204 is in front of the sensor end 192 of the proximity switch 190. When the magnet 204 is detected by the proximity switch 190 a predetermined quantity of times corresponding to a desired choke plate 116 position, the feedback signal stops the motor 212.

In one embodiment, the adapter 174 is of a tubular construction wherein an operator can view the indicator ring 198 through an open side of the adapter 174. In one embodiment, marks on the indicator side 202 can be viewed and the alignment compared with stationary marks on the adapter 174 to determine the position of the choke plate 116. When an operator uses the handwheel 240 to manually rotate the choke plate 116, the position indicator 188 is used to indicate the position of the choke plate 116 relative to the fixed plate 120. In one embodiment, the operator looks through the tubular adaptor 174, between the choke assembly 106 and the actuator housing 172 and lining up the markings on the indicator ring 198 with the corresponding markings on the top of the adapter 174.

One or more sensors 126 are located within the wellbore 102 to measure predetermined parameters. In one embodiment, sensor communication cables 128 connect the sensors 126 and the local panel 150. In one embodiment, the remote actuator panel 130 includes preprogrammed algorithms operative to interpret measurement data and transmit responsive instruction to the motor 212 to open or close the choke plate 116. In one embodiment, wherein the local panel 150 includes the emergency stop button 152, instruction from the remote actuator panel 130 to the motor 212 is routed through the local panel 150 because the emergency stop cannot be bypassed. In one embodiment, the local panel 152 includes preprogrammed algorithms operative to interpret measurement data and transmit responsive instruction to the motor 212.

The apparatus 100 provides the operator with three methods of control. The first method is electronically through the use of the remote panel 130 from a remote location such as the doghouse 103. The second method allows the operator to control the choke assembly 106 electronically from the local panel 150 in the manifold shack 104. The final method of control is by using the manual hand wheel 240 coupled to the back of the actuator 170.

All of the electronic components are housed in air tight housings 132, 158 within which continual air purge is provided. The motor housing 178 is explosion proof and an explosion proof junction box 214 receives armored switch and control communication cables 196 and 166 directed to the motor 212. Thus, the control system 100 is safe for use in a hazardous area pursuant to Class 1 Division 1 standards.

Figure 11:
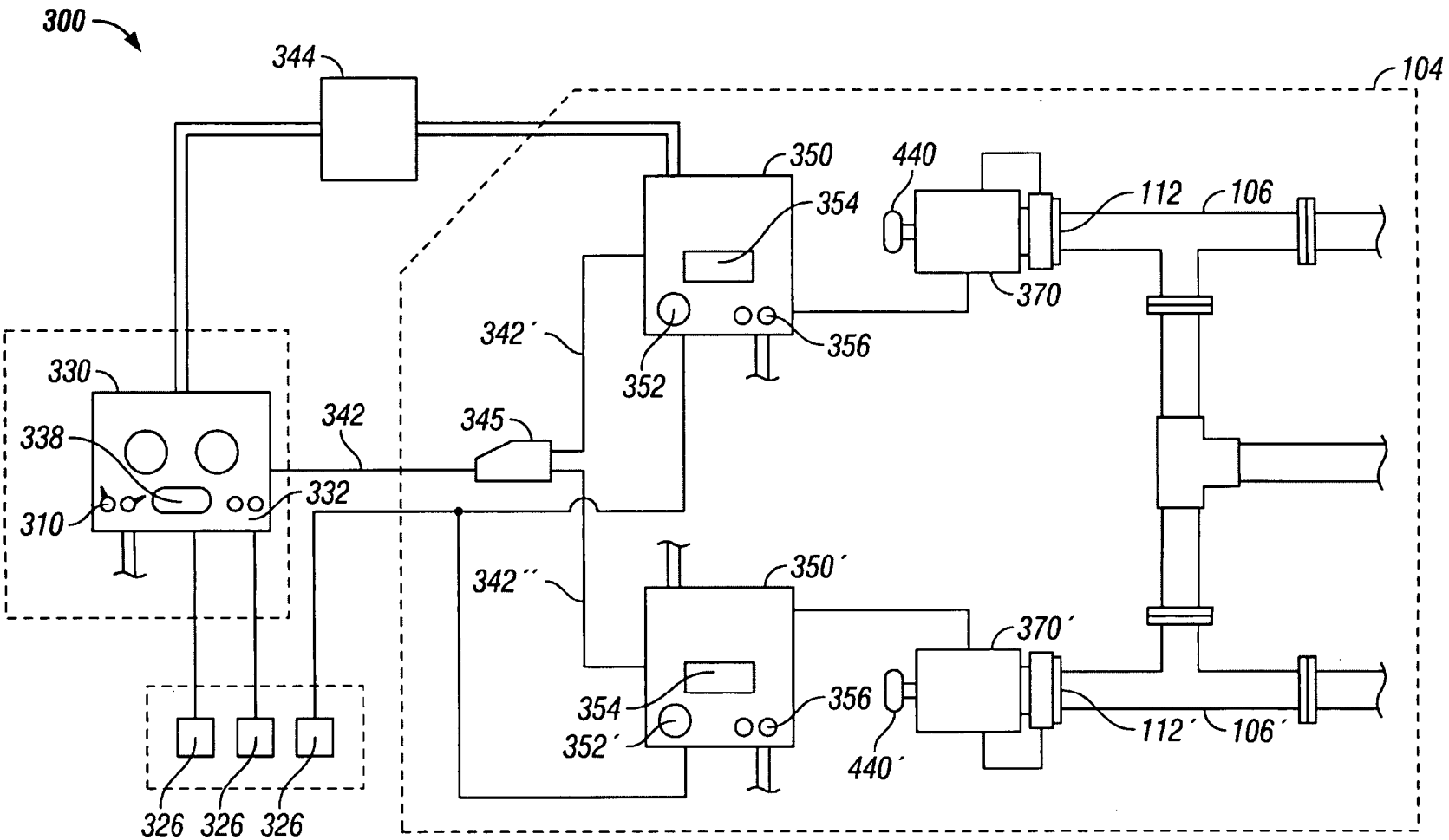
FIG. 11 is a schematic of a control system for dual choke valve pressure control including a second pressure control device.

Referring to FIG. 11, in one embodiment, there is provided an apparatus for pressure control of a fluid system having at least one redundant, or back-up pressure control device, or choke assembly 106, 106'. This system, generally designated 300, includes a remote panel 330, a plurality of local panels 350, 350', a plurality of actuators 370, 370', and at least one sensor 326.

The choke assemblies 106, 106' each have a configuration such as that previously described. The single fluid path to the set of chokes 106, 106' divides to provide an individual fluid path to each choke assembly 106, 106'. A valve may be present to direct flow into one of the individual fluid paths.

In this embodiment, the remote panel 330 includes a choke selection switch 310 on the panel. In one embodiment, the switch 310 is toggled between two or more detent locations corresponding to the two or more choke assemblies 106, 106'. In one embodiment, the digital display 338 provides data from a selected choke assembly 106 or 106'. In another embodiment, the digital display provides data from both choke assemblies 106, 106' simultaneously. A panel communication cable 342 splits into corresponding segments 342', 342", etc. to provide electronic communication between the remote panel 330 and each local panel 350, 350'. In one embodiment, a molded junction box 345 is present at the intersection of the communication cables.

To ensure that the remote panel 330 is safe for operation in an area that is classified as hazardous, the housing 332 is air-tight and the air purge system 344 provides clean air into the housing 332. The air purge system 344 also provides air circulation through each local panel 350, 350', etc.

The local panels 350, 350', located at the choke manifold 104, provide the secondary interface for the operator to control the chokes 106, 106'. In one embodiment, controls 356 and displays 354 are present. In one embodiment, an emergency stop button 352, 352' is located on each local panel 350, 350'. Each communication cable segment 342', 342" is connected to the corresponding local panel 350, 350'.

An actuator 370, 370' is attached to the actuator end 112, 112' of a corresponding choke assembly 106, 106'. In one embodiment, each actuator 370, 370' includes a manual hand wheel 440, 440', providing manual control of each choke assembly 106, 106'. The local panels 350, 350' provide electronic control of the corresponding choke assembly 106, 106'. The remote panel 330, provides remote electronic control of each choke assembly 106, 106' independently by selecting the appropriate choke 106, 106' with the choke selection switch 310.

It will be understood by those of skill in the art that any number of choke assemblies 106, 106' may be controlled with the control system 300 described. An actuator 370, 370' is to be operatively attached to the actuator end of each choke 106, 106' to be controlled. A local panel 350, 350' electronically communicates with each actuator 370, 370'. Only one remote panel 330 is required, wherein a choke selection switch 310 is used to select control of any one of the choke assemblies 106, 106'.

In one aspect, the present invention generally relates to a control system for a pressure control device, or choke assembly, which can be used in a hazardous area and meets standards established by the American Petroleum Institute (API). The pressure control device, or choke, may be used in conjunction with a BOP (Blow Out Preventer) to allow safe evacuation of high-pressure gas/fluids from the well bore during a well control situation (kick). This is accomplished by varying the opening size of the choke valve through which the fluid/gas is flowing to increase/decrease flow in order to maintain a stable drill pipe or casing pressure, depending on the situation.

While the claimed subject matter has been described with respect to a limited number of embodiments, those skilled in the art, having benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. An apparatus for controlling a choke assembly, wherein the choke assembly includes a housing having an inlet and an outlet in fluid communication with a wellbore, a fixed plate located between the inlet and the outlet and having an orifice therethrough for communicating fluid from the inlet to the outlet, a choke plate rotatably retained against the fixed plate and having an orifice therethrough, wherein the choke plate is rotatable to adjust a size of an orifice resulting from the relative positions of the orifice through the choke plate and the orifice through the fixed plate and is further rotatable to close the resulting orifice to prevent fluid communication therethrough, the apparatus comprising:

an air source;

an air purge system in fluid communication with the air source;

a remote operating panel receiving data from at least one remotely located wellbore sensor, the remote operating panel comprising:

an airtight housing in fluid communication with the air purge system, wherein air from the air purge system is circulated through the housing;

a plurality of operator controls located on the housing for manually controlling operation of the choke assembly; and a display located on the housing for visually displaying values of data received from the wellbore sensor;

a local operating panel in electronic communication with the remote operating panel, the local operating panel comprising:

an airtight local panel housing in fluid communication with the air purge system, wherein air from the air purge system is circulated through the panel housing; and a local operator controller having an operator interface for receiving operator instruction input into the local panel, and operable to receive operator instructions from the remote panel and transmit operator instructions; and an actuator coupled to the choke assembly to control pressure within the wellbore, the actuator comprising:

a motor in an explosion-proof housing coupled to the choke plate and operable to adjust the orifice through the choke plate, wherein the motor receives electronic communication of the operator instructions transmitted by the local operator controller; and a position indicator coupled to the choke plate for sensing the orifice opening and providing feedback of the choke plate position to the motor.

2. The apparatus of claim 1, wherein the local operator panel is located at a choke manifold.

3. The apparatus of claim 2, wherein the local operator panel further comprises:

an emergency stop button for shutting off power to the actuator.

4. The apparatus of claim 2, wherein the local operator panel receives data from at least one remotely located wellbore sensor.

5. The apparatus of claim 4, wherein the local operator panel further comprises:

a digital display for observing measured data transmitted by the sensor.

6. The apparatus of claim 2, wherein the local operator panel receives data from the remote panel and the local operator panel further comprises:

a digital display for observing data transmitted from the remote panel.

7. The apparatus of claim 2, wherein the local operator controller of the local operator panel further comprises:

an open/close lever for operating the actuator.

8. The apparatus of claim 2, wherein the position indicator of the actuator further comprises:

a rotatable indicator ring coupled to the choke plate;

a magnet housed within a side of the indicator ring;

a proximity switch spaced apart from the side of the indicator ring and actuated when the indicator ring is rotated such that the magnet is within a predetermined distance of the proximity switch, wherein the proximity switch transmits a signal to the motor when actuated; and wherein the predetermined distance of the magnet to the proximity switch corresponds to a predetermined position of the choke plate.

9. An apparatus for controlling a plurality of choke assemblies, wherein each choke assembly includes a housing having an inlet and an outlet in fluid communication with a wellbore, a fixed plate located between the inlet and the outlet and having an orifice therethrough for communicating fluid from the inlet to the outlet, a choke plate rotatably retained against the fixed plate and having an orifice therethrough, wherein the choke plate is rotatable to adjust a size of an orifice resulting from the relative positions of the orifice through the choke plate and the orifice through the fixed plate and is further rotatable to close the resulting orifice to prevent fluid communication therethrough, the apparatus comprising:

an air source;

an air purge system in fluid communication with the air source;

a remote operating panel receiving data from at least one remotely located wellbore sensor, the remote operating panel comprising:

an airtight housing in fluid communication with the air purge system, wherein air from the air purge system is circulated through the housing;

a toggle switch located on the housing for selecting one of the choke assemblies to be controlled;

a plurality of operator controls located on the housing for manually controlling operation of the selected choke assembly;

a display located on the housing for visually displaying values of data received from the wellbore sensor;

a local operating panel corresponding to each choke assembly being controlled, wherein each local operating panel is in electronic communication with the remote operating panel, each local operating panel comprising:

an airtight local panel housing in fluid communication with the air purge system, wherein air from the air purge system is circulated through the panel housing; and a local operator controller having an operator interface for receiving operator instruction input into the local panel, and operable to receive operator instructions from the remote panel and transmit operator instructions; and an actuator corresponding to each choke assembly and coupled thereto, the actuator comprising:

a motor in an explosion-proof housing coupled to the choke plate and operable to adjust the orifice through the choke plate, wherein the motor receives electronic communication of the operator instructions transmitted by the local operator controller; and a position indicator coupled to the choke plate for sensing the orifice opening and providing feedback of the choke plate position to the motor.

10. The apparatus of claim 9, wherein each local operator panel receives data from at least one remotely located wellbore sensor, each local operator panel further comprising:

a digital display for observing measured data transmitted by the sensor.

11. The apparatus of claim 10, wherein each local operator panel receives data from the remote panel.

12. The apparatus of claim 9, wherein the position indicator of each actuator further comprises:

a rotatable indicator ring coupled to the choke plate;

a magnet housed within a side of the indicator ring;

a proximity switch spaced apart from the side of the indicator ring and actuated when the indicator ring is rotated such that the magnet is within a predetermined distance of the proximity switch, wherein the proximity switch transmits a signal to the motor when actuated; and wherein the predetermined distance of the magnet to the proximity switch corresponds to a predetermined position of the choke plate.

13. An apparatus for controlling pressure in a wellbore comprising:

a choke assembly comprising:

a housing having an inlet and an outlet in fluid communication with the wellbore;

a fixed plate between the inlet and the outlet having an orifice therethrough for communicating fluid from the inlet to the outlet;

a choke plate rotatably retained against the fixed plate and having an orifice therethrough;

wherein the choke plate is rotatable to adjust a size of an orifice resulting from the relative positions of the orifice through the choke plate and the orifice through the fixed plate and is rotatable to close the resulting orifice to prevent fluid communication therethrough;

an air source;

an air purge system in fluid communication with the air source;

a remote operating panel receiving data from at least one remotely located wellbore sensor, the remote operating panel comprising:

an airtight housing in fluid communication with the air purge system, wherein air from the air purge system is circulated through the housing;

a plurality of operator controls located on the housing for manually controlling operation of the choke assembly; and a display located on the housing for visually displaying values of data received from the wellbore sensor;

a local operating panel in electronic communication with the remote operating panel, the local operating panel comprising:

an airtight local panel housing in fluid communication with the air purge system, wherein air from the air purge system is circulated through the panel housing; and a local operator controller having an operator interface for receiving operator instruction input into the local panel, and operable to receive operator instructions from the remote panel and transmit operator instructions; and an actuator coupled to the choke assembly to control pressure within the wellbore, the actuator comprising:

a motor in an explosion-proof housing coupled to the choke plate and operable to adjust the orifice through the choke plate, wherein the motor receives electronic communication of the operator instructions transmitted by the local operator controller; and a position indicator coupled to the choke plate for sensing the orifice opening and providing feedback of the choke plate position to the motor.

14. The apparatus of claim 13, wherein the local operator panel receives data from at least one remotely located wellbore sensor, and the local operator panel further comprises:

a digital display for observing measured data transmitted by the sensor.

15. The apparatus of claim 14, wherein the local operator panel receives data from the remote panel.

16. The apparatus of claim 13, wherein the position indicator of the actuator further comprises:

a rotatable indicator ring coupled to the choke plate;

a magnet housed within a side of the indicator ring;

a proximity switch spaced apart from the side of the indicator ring and actuated when the indicator ring is rotated such that the magnet is within a predetermined distance of the proximity switch, wherein the proximity switch transmits a signal to the motor when actuated; and wherein the predetermined distance of the magnet to the proximity switch corresponds to a predetermined position of the choke plate.

* * * * *